US005407380A

United States Patent [19]

Salkewicz

[11] Patent Number: 5,407,380

[45] Date of Patent: Apr. 18, 1995

[54] GRINDER MOTOR STAND

[76] Inventor: Doug Salkewicz, 124 Norris Rd., Etowah, N.C. 28729

[21] Appl. No.: 160,043

[22] Filed: Nov. 30, 1993

[51] Int. Cl.[6] ..... B24B 41/00

[52] U.S. Cl. ..... 451/340; 451/361

[58] Field of Search ..... 51/166 R, 166 TS, 166 FB, 51/168; 83/57, 68; 248/637, 644; 82/905; 408/5, 234; 409/235, 286, 337

[56] References Cited

U.S. PATENT DOCUMENTS

| | | | |
|---|---|---|---|
| 544,236 | 8/1895 | Pohlman . | |
| 1,575,307 | 3/1926 | Bachmann . | |
| 1,728,487 | 9/1929 | Gardner . | |
| 1,890,675 | 12/1932 | Doerr et al. | 51/166 FB |
| 1,995,421 | 3/1935 | Goldberg | 64/30 |
| 2,061,626 | 11/1936 | Hawes | 51/166 FB |
| 2,447,618 | 8/1948 | Nicholson | 51/166 FB |
| 3,054,231 | 9/1962 | Romanek | 51/166 |
| 3,863,910 | 2/1975 | Warax | 269/11 |
| 3,888,049 | 6/1975 | MacSween | 51/166 FB |
| 4,123,877 | 11/1978 | Pere | 51/166 FB |

FOREIGN PATENT DOCUMENTS

| | | | |
|---|---|---|---|
| 1007357 | 5/1952 | France | 51/166 FB |

*Primary Examiner*—Maurina T. Rachuba
*Attorney, Agent, or Firm*—Cort Flint

[57] ABSTRACT

A grinder motor stand is disclosed which includes a base upon which an adjustable upstanding post is affixed. Preferably, the upstanding post extends through a central base opening and is affixed beneath an upper wall of the base so that two spaced points of affixation are provided for resisting bending moments on the upstanding shaft. An integral junction box is provided in the base having a male plug and a female socket wired in series and grounded to the base. The female socket of the junction box mates with a male plug of an electrical cord from a grinding motor supported on the stand. The male plug of the junction box mates with a female plug of a foot pedal control used to control the grinding motor. The base is weighted, and the two-point attachment of the upstanding posts provide a stable grinding motor stand which can be easily moved around and transported. The entire assembly may be knocked down for shipping or transportation.

13 Claims, 2 Drawing Sheets

Fig. 1-A.

GRINDER MOTOR STAND

BACKGROUND OF THE INVENTION

The invention relates to a portable stand for a grinder motor, and more particularly, to such a stand that is portable yet is sufficiently stable for supporting a heavy grinder motor and the like and which provides for electrical hook-up and control of the motor.

Previously, various arrangements have been proposed for supporting electric motors having controls used in different applications. For example, U.S. Pat. No. 5,444,236 discloses a flexibly mounted rotary tool which is driven from a motor supported on a wall mounted support. U.S. Pat. No. 3,054,231 discloses a foot control for controlling a motor which drives grinding wheels. U.S. Pat. No. 3,863,910 discloses an upright stand which includes an electrical outlet mounted on a portable work frame. However, none of these arrangements provide a simple and reliable portable stand which is suitable for stably supporting a heavy grinding motor in such a manner that the electrical hook up and control of the motor may also be had.

Accordingly, an object of the invention is a grinding motor stand which is portable and from which a heavy grinding motor may be suspended in a stable manner.

Another object of the invention is to provide a portable grinding motor stand for stably supporting a grinding motor which provides electrical hook up and control of the grinding motor.

Another object of the invention is to provide a portable stand for a grinding motor which has a stable telescoping post supported by a stable base which incorporates an electrical junction box for hook up and control of an electrical grinding motor suspended from the stand.

SUMMARY OF THE INVENTION

The above objectives are accomplished according to the present invention by providing a portable motor stand for supporting a grinding motor having a foot pedal control. The foot pedal control has a first electrical control cord which has a male plug. The foot pedal has a second electrical control cord having a female socket. The grinding motor stand comprises a base which is supported on a surface and an upstanding post affixed to the base. The upstanding post has a free end remote from the base. A support is carried near the free end of upstanding post on which the grinding motor is supported. An electrical junction box is carried by the base and has a male plug for receiving the female socket of the control cord of the foot pedal. The electrical junction box has an electrical female receptacle electrically connected to the male plug. The female socket of the junction box receives the male plug of the motor cord. The upstanding post includes a telescoping post assembly which has a bottom post affixed to the base. A top post is slidably received within the bottom post and has a remote end constituting the free end of the upstanding post. A lock assembly is carried by the telescoping post assembly which locks the bottom and top post together with the top post in a desired vertical position. An interfitting joint formed between the bottom post and top post prevents the top post from being pulled outwardly from the bottom post in an upward vertical position to prevent separation of the post on the base. The base includes a central opening formed in a top surface of the base. The bottom post extends through the opening of the base and is affixed to a lower surface of the base. A fixture assembly affixes the bottom post to the lower surface of the base so that the bottom post is affixed at one location to the base and abuts the base in an area of the based opening at a second location spaced a distance from the first location to effectively resist bending movements from the supported grinding motor. The fixture assembly includes a plate affixed near a free end of the bottom post, and at least two bosses protruding from the lower surface of the base to which the plate is secured.

A cover plate covers the electrical junction box. The cover plate has a first opening permitting access to the junction box male plug and a second opening providing access to the junction box female receptacle. First and second movable closures are carried by the cover plate which open and close the first and second access openings.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1A is an enlarged perspective view of an electrical junction box for a foot or other control incorporated into the portable stand of the preset invention.

DESCRIPTION OF A PREFERRED EMBODIMENT

Figure 1:
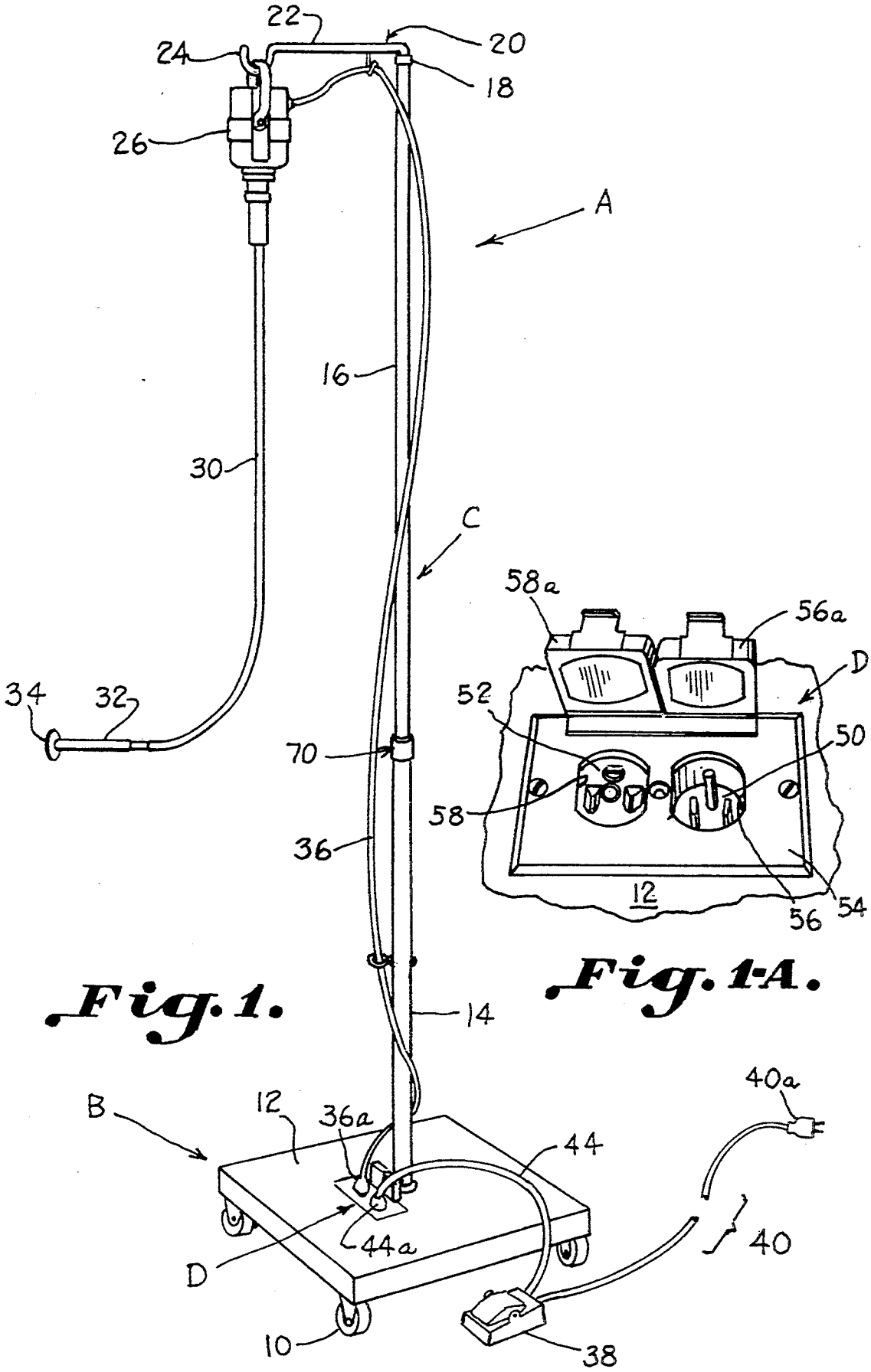
FIG. 1 is a perspective view of a portable grinding motor stand constructed in accordance with the present invention.

Referring now in more detail to the drawings, a portable stand, designated generally as A, for a grinding motor and the like will now be described according to one embodiment of the invention. As can best be seen in FIG. 1, the illustrated embodiment of the invention includes a base B which is supported on a support surface such as a floor. For portability, the stand may include a set of four rollers or casters 10 carried near the four corners of the base. In the illustrated embodiment, the base is a square base having an upper surface 12. Alternately, a set of four adjustable legs may be utilized to support the base on a support surface. It is important that the legs or the casters provide a level support for the base so that it will not tip when supporting a heavy grinding motor and the like.

A telescoping post assembly C is carried by base B and includes a bottom post 14 and a top post 16 which telescope with respect to each other so that an adjustable vertical height may be had for the upstanding post provided by the bottom and top post. The upstanding post so provided includes a free end 18 remote from the base near which a cantilevered support 20 is carried. In the illustrated embodiment, support 20 is in the form of a cantilevered arm 22 having a hook 24 formed on its free end which receives the handle of a grinding motor 26 which may be any standard grinding motor. Cantilevered arm 22 has a vertical leg 28 affixed in a journal formed in free end 18 of top post 16. A brass insert bushing 29 provides the journal.

As illustrated, grinding motor 26 may be any suitable grinding motor which typically includes a flexible shaft 30 having a hand piece 32 affixed to the end which includes a rotary grinding tool 34. The grinding tool may be any suitable grinding tool such as a burr which is utilized to grind and finish injection molds and other metal pieces. Grinding motor 26 includes an electrical motor cord 36 having a male plug 36*a* affixed to a free end. A foot pedal control 38 is usually employed with grinding motor 26 and includes a first electrical control cord 40 having a male plug 40*a* which may be received in a conventional AC power socket 42. Foot pedal control 38 typically includes a second electrical control cord 44 having a female socket 44a on its free end. In conventional operation, male plug 36*a* of electrical motor cord 36 is mated with female socket 44*a* of foot pedal cord 44.

Figure 2:
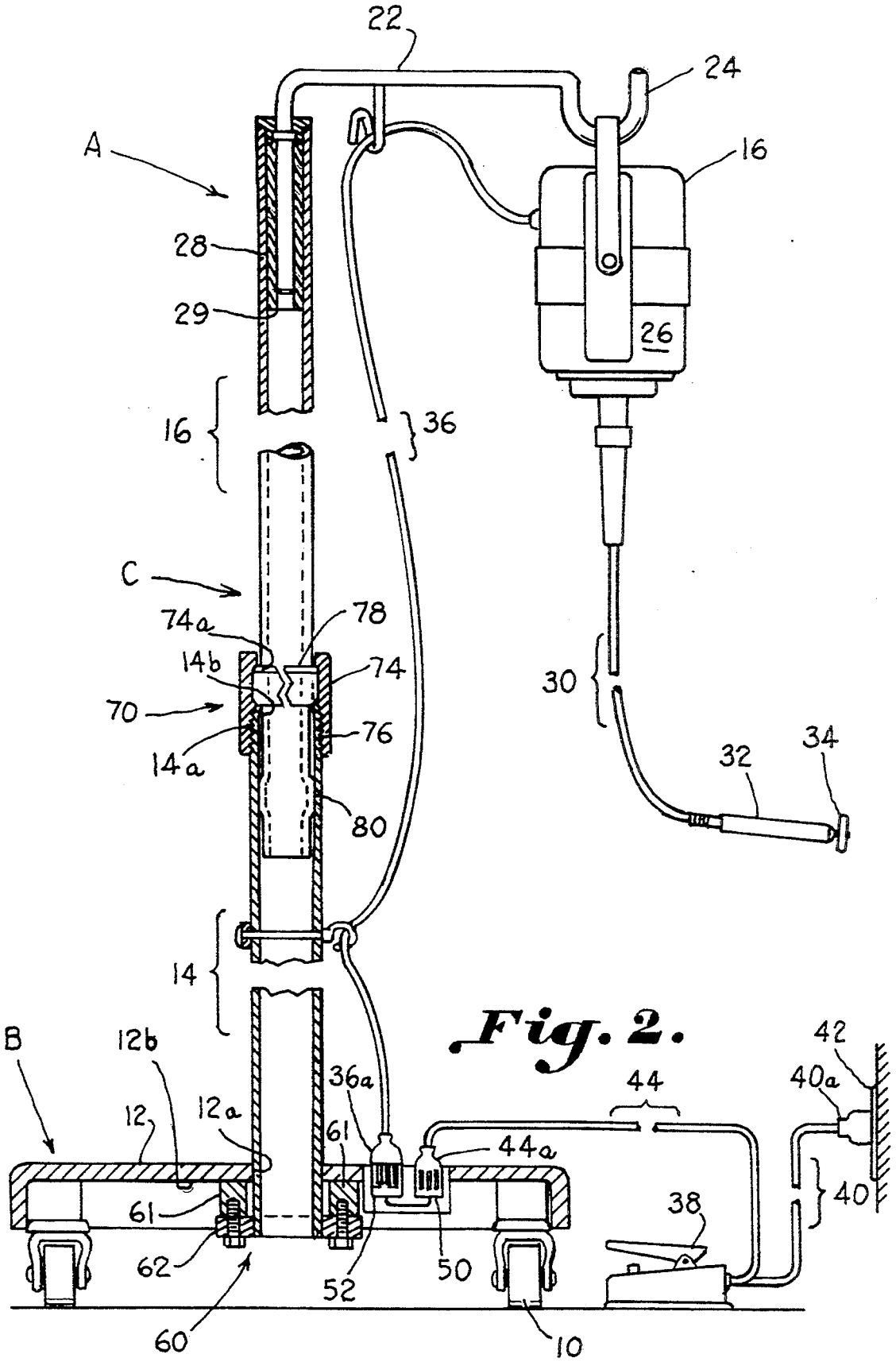
FIG. 2 is a sectional view taken along line 2—2 of FIG. 1.

In accordance with the present invention, an electrical junction box D is carried by base B for adapting the electrical hook up and motor control of grinding motor 26 unitarily with the portable stand. As can best be seen in FIGS. 1A and 2, junction box D includes a male plug 50 which mates with female socket 44*a* of second control cord 44. The junction box further includes a female receptacle 52 for mating with male plug 36*a* of motor cord 36. In the illustrated embodiment, junction box D is recessed in upper surface 12 of base B and includes a cover plate 54 having first and second access openings 56 and 58 providing access to male plug 50 and female receptacle 52, respectively. Movable closures 56*a* and 58*a* are provided for opening and closing the access openings 56 and 58, respectively, when not in use. Male plug 50 and female socket 52 are wired together in series and are grounded to base B. Foot control cord 44 and motor cord 36 are connected together in series by the junction box. A safe electrical connection, which is grounded, is provided by the base junction box. The junction box provides a connection that is fixed and avoids dangling cords which otherwise might be tripped on.

The illustrated embodiment permits the stand to be knocked down for shipping and/or transportation. For this purpose, a base opening 12*a* is formed in an upper wall 12 of base B provides for insertion of bottom post 14 through the base. A fixture assembly 60 provides for attachment of the bottom post to a lower wall surface 12*b* of base B. The fixture assembly includes protruding boss in the form of a pair of spaced blocks 61 onto which a flange 62 is bolted by means of conventional bolts. Flange 62 is either welded or shrunk-fit onto the outside of bottom post 14. It will be noted that a two-point attachment is provided where bottom post is attached by flange plate 62 and where the post contacts the inside edge of circular opening 12*a*. There is about one inch between the two points of contact that assists in resisting binding forces on the post assembly from the heavy weight of motor 26 suspended from arm 20. Lock 70 for locking top post 16 and bottom post 14 together with top post 16 in a desired vertical position relative to the bottom post is provided by a standard cam lock having a lock cap 74 threaded onto exterior threads 76 formed on the outside circumference of the upper end of bottom post 14. A split nylon bushing 78 is interfitted between the lower end of top post 16 and free end 14*a* of bottom post 14, as can best be seen in FIG. 2. As cap 74 is threaded downwardly, split bushing 78 is forced against a tapered surface 74*a* of cap 74 forcing it to tighten around top post 16 and lock the position in place. A free end 16a of top post 16 is expanded at 80 so as to define an interfit joint which prevents movement past a rounded lip 14*b* of post 14 which is turned inwardly. This prevents outward movement of top post 16 in an upward vertical direction and separation of the two posts. This is a highly important advantage when considering a very heavy grinding motor 26 is supported on the free end. Otherwise, during vertical adjustment of the post, it might be possible to separate the post resulting in toppling of the motor. In addition, to provide a stable stand, base B is provided with sufficient weight, i.e. approximately thirty-five pounds so that grind motor 26 is supported in a stable manner.

While a preferred embodiment of the invention has been described using specific terms, such description is for illustrative purposes only, and it is to be understood that changes and variations may be made without departing from the spirit or scope of the following claims.

What is claimed is:

1. A portable motor stand for supporting a grinding motor of the type having a flexible shaft with a free end on which a grinding tool is attached and driven, a foot pedal control for controlling the grinding motor, said foot pedal control having a first electrical control cord with a male plug receivable in an AC power socket, and said foot pedal having a second electrical control cord with a female socket for receiving a male plug affixed to an electrical motor cord connected to said motor, said grinding motor stand comprising:

a base which is supported on a surface;

an upstanding post affixed to said base, said upstanding post having a free end remote from said base;

a support carried near said free end of said upstanding post on which said grinding motor is supported; and an electrical junction box for connecting said foot pedal control to said grinding motor, said electrical junction box being carried by said base and having a male plug for receiving said female socket of said second electrical control cord of said foot pedal, said electrical junction box having an electrical female receptacle electrically connected to said male plug for receiving said male plug of said electrical motor cord.

2. The apparatus of claim 1 wherein said upstanding post includes a telescoping post assembly having a bottom post affixed to said base;

a top post slidably received within said bottom post having a remote end constituting the free end of said upstanding post; and a lock carried by said telescoping post assembly which locks said bottom and top post together with said top post in a desired vertical position.

3. The apparatus of claim 2 including an interfitting joint formed between said bottom post and top post which prevents said top post from being pulled outwardly from said bottom post in an upward vertical position to prevent separation of said post on said base.

4. The apparatus of claim 3 wherein said base includes a central opening formed in a top surface of said base, and said bottom post extends through said opening of said base and is affixed to a lower surface of said base.

5. The apparatus of claim 4 including a fixture assembly which affixes said bottom post to said lower surface of said base so that bottom post is affixed at one location to said base and said bottom post abuts said base in an area of said based opening at a second location spaced a distance from said first location to effectively resist bending movements from said supported grinding motor.

6. The apparatus of claim 5 wherein said fixture assembly includes a plate affixed near a free end of said bottom post, and at least two bosses protruding from said lower surface of said base to which said plate is secured.

7. The apparatus of claim 1 wherein said electrical junction box is recessed in said base, and including a cover plate covering said electrical junction box at an upper surface of said base, said cover plate having a first opening permitting access to said junction box male plug, said cover plate having a second opening providing access to said junction box female socket; and first and second movable closures carried by said cover plate which open and close said first and second access openings.

8. The apparatus of claim 1 wherein said support carried by said free end of said upstanding post comprises a cantilever arm, and a generally vertical leg integral with said cantilever arm; and a bearing affixed in said free end of said upstanding post in which said vertical leg of said cantilevered arm is journably received.

9. The apparatus of claim 1 including a plurality of pig tails carried by said upstanding post for routing said motor electrical cord to said electrical junction box.

10. A portable stand for supporting a grinding motor and the like in a stable manner yet which may be disassembled for transportation, said stand comprising:

a base which is supported on a support surface, and said base having a generally solid planar upper wall;

a telescoping post assembly for attachment to said base in an upstanding manner;

said telescoping post assembly comprising a bottom post having a free end which is received through a base opening formed in an upper wall of said base to define a free end portion extending through said upper wall, and a top post which is slidably received in said bottom post;

a fixture assembly for attaching said free end portion of said bottom post beneath said upper wall to said base in a manner that said bottom post abuts said upper wall in a region of said base opening at a location spaced a distance at which said free end portion is affixed to said base;

a lock assembly for fixing said top post and bottom post together with said top post in a desired vertical position relative to said bottom post;

a support carried by said top post for supporting said grinding motor.

11. The apparatus of claim 10 including an electrical junction box carried by said base having a male plug for receiving said female socket of said second electrical control cord of said foot pedal, said electrical junction box having an electrical female socket electrically connected to said male plug for receiving said male plug of said electrical motor cord, and said male plug and said female socket of said junction box are grounded.

12. The apparatus of claim 11 wherein said electrical junction box is recessed in said base, and including a cover plate covering said electrical junction box at an upper surface of said base, said cover plate having a first opening permitting access to said junction box male plug, said cover plate having a second opening providing access to said junction box female socket; and first and second movable closures carried by said cover plate which open and close said first and second access openings.

13. In combination, a portable motor stand and a grinding motor having a flexible shaft with a free end adapted for attachment and driving of a grinding tool, wherein said combination further comprises:

a foot pedal control for controlling the grinding motor, said foot pedal control having a first electrical control cord with a male plug receivable in an AC power socket, said foot pedal having a second electrical control cord with a female socket;

a male plug affixed to an electrical motor cord connected to said motor, said grinding motor stand comprising a base which is supported on a surface;

an upstanding post affixed to said base, said upstanding post having free end remote from said base;

a support carried near said free end of said upstanding post on which said grinding motor is supported; and an electrical junction box carried by said stand having a male plug receiving said female socket of said second electrical control cord of said foot pedal, said electrical junction box having an electrical female receptacle electrically connected to said male plug receiving said male plug of said electrical motor cord.

* * * * *